United States Patent [19]

Henke

[11] Patent Number: 4,885,876

[45] Date of Patent: Dec. 12, 1989

[54] SANDER TOOL APPARATUS

[75] Inventor: David R. Henke, Maple Grove, Minn.

[73] Assignee: Warner Manufacturing Company, Minneapolis, Minn.

[21] Appl. No.: 210,213

[22] Filed: Jun. 17, 1988

Related U.S. Application Data

[63] Continuation of Ser. No. 905,162, Sep. 11, 1986, abandoned.

[51] Int. Cl.[4] ..... B24D 15/02

[52] U.S. Cl. ..... 51/393; 51/392; 51/371; 15/144 A; 15/231; 15/228; 403/58

[58] Field of Search ..... 51/358, 370, 371, 382, 51/383, 384, 391, 392, 393; 15/143 R, 144 R, 144 A, 231, 232, 233, 176, 210 R, 228; 16/337, 342; 403/58, 74, 94

[56] References Cited

U.S. PATENT DOCUMENTS

| | | | |
|---|---|---|---|
| D. 274,952 | 7/1984 | Gringer . | |
| D. 274,953 | 7/1984 | Gringer . | |
| D. 282,881 | 7/1984 | Gringer . | |
| 1,544,368 | 6/1925 | Brennan . | |
| 1,966,633 | 7/1934 | Lee . | |
| 2,201,645 | 5/1940 | Epner . | |
| 2,334,039 | 11/1943 | Rueb . | |
| 2,437,827 | 3/1948 | Lund | 51/392 X |
| 2,454,668 | 11/1948 | Nissenbaum | 51/391 X |
| 2,663,979 | 12/1953 | Sierchio | 51/393 X |
| 2,711,059 | 6/1955 | Ames . | |
| 2,811,349 | 10/1957 | Bondurant et al. | 403/58 X |
| 2,848,850 | 8/1958 | Metoff . | |
| 2,954,649 | 10/1960 | Carroll et al. . | |
| 2,957,282 | 10/1960 | Swanson | 51/170 TL |
| 3,123,946 | 3/1964 | Hoveland . | |
| 3,224,149 | 12/1965 | Harrington et al. | 51/386 |
| 3,362,037 | 1/1968 | Griffin . | |
| 3,483,662 | 12/1969 | Ames . | |
| 3,498,009 | 3/1970 | Taafe, Jr. | 51/393 |
| 3,520,059 | 7/1970 | Gringer . | |
| 3,850,533 | 11/1974 | Thielen . | |
| 3,887,973 | 6/1975 | Coon . | |
| 3,906,625 | 9/1975 | Gringer . | |
| 3,991,431 | 11/1976 | Thielen | 15/228 X |
| 4,005,525 | 2/1977 | Gringer . | |
| 4,221,084 | 9/1980 | Frantzen | 51/392 |
| 4,225,998 | 10/1980 | Thielen . | |
| 4,399,580 | 8/1983 | Stark | 15/176 X |
| 4,475,262 | 10/1984 | Downer . | |
| 4,516,360 | 5/1985 | Gringer et al. . | |
| 4,516,361 | 5/1985 | Gringer . | |
| 4,658,461 | 4/1987 | Rue et al. | 15/210 R |

FOREIGN PATENT DOCUMENTS

| | | |
|---|---|---|
| 2257393 | 1/1974 | France . |
| 449803 | 1/1950 | Italy . |
| 53919 | 8/1911 | Switzerland . |
| 84039 | 4/1919 | Switzerland . |
| 318756 | 3/1957 | Switzerland . |

*Primary Examiner*—Robert P. Olsewski

*Attorney, Agent, or Firm*—Merchant, Gould, Smith, Edell, Welter & Schmidt

[57] ABSTRACT

A sander tool (20) including a base structure (26) and interchangeable pole sander top structure (28) and hand sander top structure (30) so as to form a pole sander (22) and a hand sander (24), respectively. The pole sander (22) includes a resilient universal joint (74) to permit substantially universal movement of a handler member (72).

3 Claims, 3 Drawing Sheets

SANDER TOOL APPARATUS

This is a continuation of application Ser. No. 905,162, filed Sept. 11, 1986, now abandoned.

BACKGROUND OF THE INVENTION

The present invention relates to hand sanders and pole sanders and more particularly to a sander including a base structure with interchangeable hand sander top structure and pole sander top structure such that a hand sander or pole sander can be made using the same base structure.

Pole sanders and hand sanders are well known. Pole sanders usually employ some type of universal joint in order to permit the flat sandpaper surface, which is generally secured to a flat back surface of the sander, to parallel the wall or ceiling or floor surface against which the sandpaper is applied during the sanding operation. In utilizing pole sanders, the user is generally a considerable distance away from the surface at the other end of the pole or broom handle through which the pressure is applied to the sandpaper surface against the surface or joint being sanded. Prior art pole sanders, although satisfactory in many instances, have several undesirable features which affect their function. The universal joint in conjunction with the sandpaper retention means which is typically present, often acts as an impediment in directing the handle or pole as low as horizontal as possible in reaching for corners or the like. U.S. Pat. Nos. 4,516,360 and 4,516,361 disclose a pole sander with a universal joint which allegedly overcomes this problem by providing sloped contoured guide ramps adjacent the universal joint. In addition, the universal joints of the above-mentioned patents employ what is referred to as a positive friction engagement, so as to allegedly overcome the problems of controlling sander movement where the u-joint does not employ such a positive friction engagement. As with most pole sanders, the above-mentioned patents employ wire clips to retain the sandpaper. Despite the advantages that the above-referenced patents may exhibit over existing pole sanders, the present invention solves many of the problems associated with the pole sanders of the above-identified patents, as well as other pole sanders and hand sanders which are currently existing in the marketplace.

SUMMARY OF THE INVENTION

The present invention relates to a sander tool apparatus for use with a sheet of sandpaper. The sander tool apparatus includes a two-piece housing structure having a molded base structure and a molded top structure. The base structure includes a substantially planar back surface facing away from the top structure. The top structure includes a handle mounting surface facing away from the base structure. Hinge means is integrally molded with the housing structure for hingedly interconnecting the base and top structures along a first side of the sander tool apparatus, whereby the sander tool apparatus can be placed in an open position wherein the base and top structures are hinged apart, and a closed position wherein the base and top structures are hinged together. Sandpaper retention means is provided for removably retaining the sandpaper on the back surface of the base structure. Latch means integrally molded with the housing structure is provided for releasably latching the base and top structures in the closed position.

In a preferred embodiment of the present invention, the top structure is interchangeable with other top structures whereby the top structure can be interchanged with a top structure having a different handle arrangement on the handle mounting surface of the top structure.

One of the top structures preferably includes a handle member integrally molded with the top structure. In the preferred embodiment, the handle member will extend longitudinally of the top structure, the handle member including an intermediate portion interconnecting to downwardly extending ends which are interconnected to the top structure. The intermediate portion is spaced apart from the top structure to allow for placement of a user's hand between the top structure and the intermediate portion of the handle member. Preferably, the intermediate portion of the handle member will include a downwardly extending arcuately contoured portion thereby providing for a comfortable grip. It will be appreciated that this top structure embodiment will provide a hand sander tool apparatus.

Yet a second one of the top structures preferably includes handle joint assembly means for interconnecting an elongated pole or broom handle to the top structure. The handle joint assembly means will include a universal joint means mounted on the top structure for allowing the back surface of the base structure to be disposed in a plurality of angular positions with respect to the handle member. Preferably, the universal joint means will include a u-shaped member straddling pin means of the top structure for pivotal movement about a first axis. Free ends of the u-shaped member will define spaced apart, aligned apertures. The handle joint assembly means includes handle attachment means for attachment to the handle member. The handle attachment means will preferably include pin means for pivotal mounting of the handle attachment means in the aligned apertures of the u-shaped member for pivotal movement of the handle attachment means and its associated handle member about a second axis perpendicular to the first axis, whereby substantially universal movement is obtained.

In one embodiment, the u-shaped member is resiliently biased toward a rest position, the u-shaped member being displaced from the rest position when pivotally mounted on the pin means of the handle attachment means, thereby providing for a friction engagement between the u-shaped member and the handle attachment means. Also, in a preferred embodiment, an outer surface of the pin means of the handle attachment means frictionally engages an inner surface defining the apertures of the u-shaped member.

The present invention also relates to a kit assembly including a base structure and interchangeable hand sander top structure and pole sander top structure, whereby the sander tool can be readily converted from a hand sander to a pole sander.

In the preferred embodiment, the pin means of the top structure is integrally molded at the top structure and is recessed within the top structure so as to lower the location which the handle member effectively forces against, thereby adding increased stability to the sander tool during use.

Additionally, a preferred embodiment of the present invention has a thin wall construction thereby providing a light weight sander. In addition to being light weight, the sander tool includes reinforcement structure such that it is strong and rigid.

In the preferred embodiment of the present invention, the top structure pin means includes an elongated pin member having four equally spaced apart, radially extending ribs, the ribs frictionally engaging the u-shaped member to provide a frictional engagement with the u-shaped member about a selected range of pivotal movement of the u-shaped member. This particular pin structure facilitates molding of pin as it eliminates distortions, sinks, etc. In addition, the top structure pin means is preferably an integral part of the top structure rather than a separate piece. This provides for easy assembly of the u-joint and handle attachment means which are designed for an easy snap together fit.

In a preferred embodiment, the hinge means and latch means are integrally molded with the sander housing structure. Preferably, the latch means includes a resilient latch member integrally molded with one of the top and base structures, the latch member being resiliently biased into a rest position. The latch member further including a shoulder portion for engaging an edge of the other one of the top and base structures when in the rest position, the shoulder portion disengaging the edge when forced into a displaced position. The latch means thus provides a "push to open" snap lock closure. The hinge and latch means make it possible to latch the sandpaper securely in place and still allow for easy sandpaper replacement. In addition, they provide for interchangeability of the two separate tops, the hand sander top structure and the pole sander top structure. Accordingly, one base structure can be utilized with two different top structures so as to make two different, discrete tools.

In the preferred embodiment of the present invention, the sandpaper retention means is integrally molded with the housing structure. In addition, the housing structure further includes integrally molded alignment means for maintaining longitudinal alignment of the sandpaper with the housing structure. Thus, in the preferred embodiment, the spring clip retention devices typically found on most sander tools are eliminated.

Preferably, the sander tool is three inches wide and of such a length that a user can cut a standard 9" × 11" piece of sandpaper in thirds and has no waste of the sandpaper.

In yet another preferred embodiment of the present invention, the central portion below the handle of the hand sander top structure is open and forms a barrier with the base structure to trap sanding dust and provide more room for the user's hand.

It will be appreciated that the base and top structures are designed so that in molding, there is no need for cams, which results in faster molding and a lower mold cost.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference letters and numerals indicate corresponding parts throughout.

DETAILED DESCRIPTION OF A PREFERRED EMBODIMENT

Figure 1:
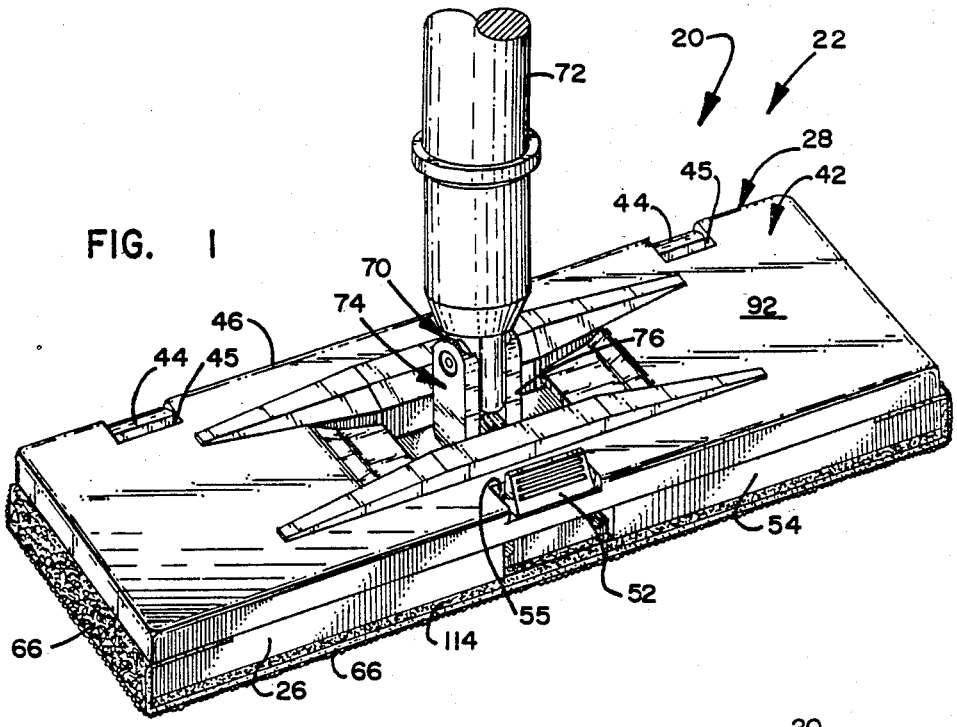
FIG. 1 is a view in perspective of an embodiment of a pole sander in accordance with the principles of the present invention.
Figure 2:
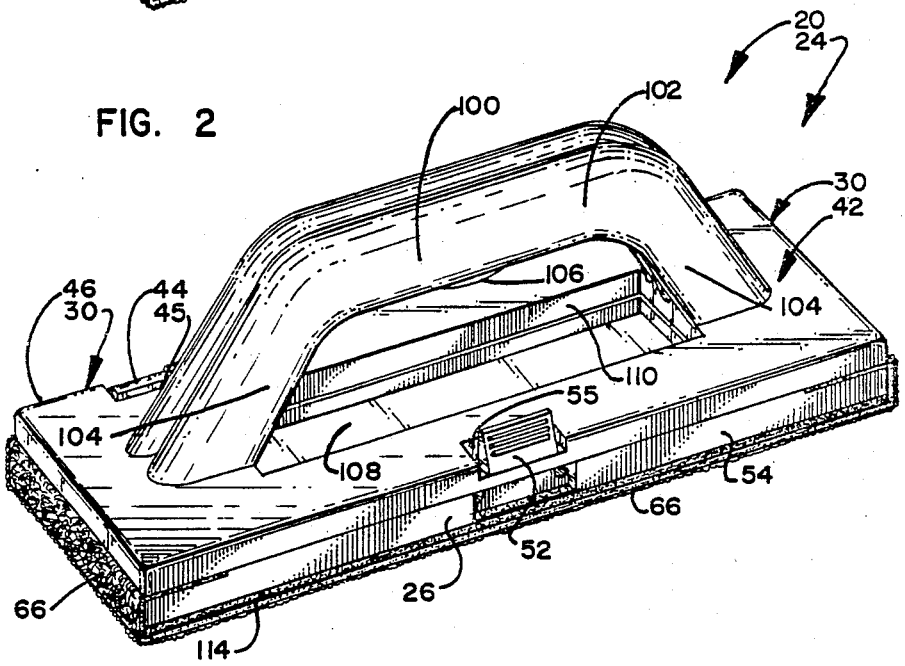
FIG. 2 is a view in perspective of an embodiment of a hand sander in accordance with the principles of the present invention.
Figure 3:
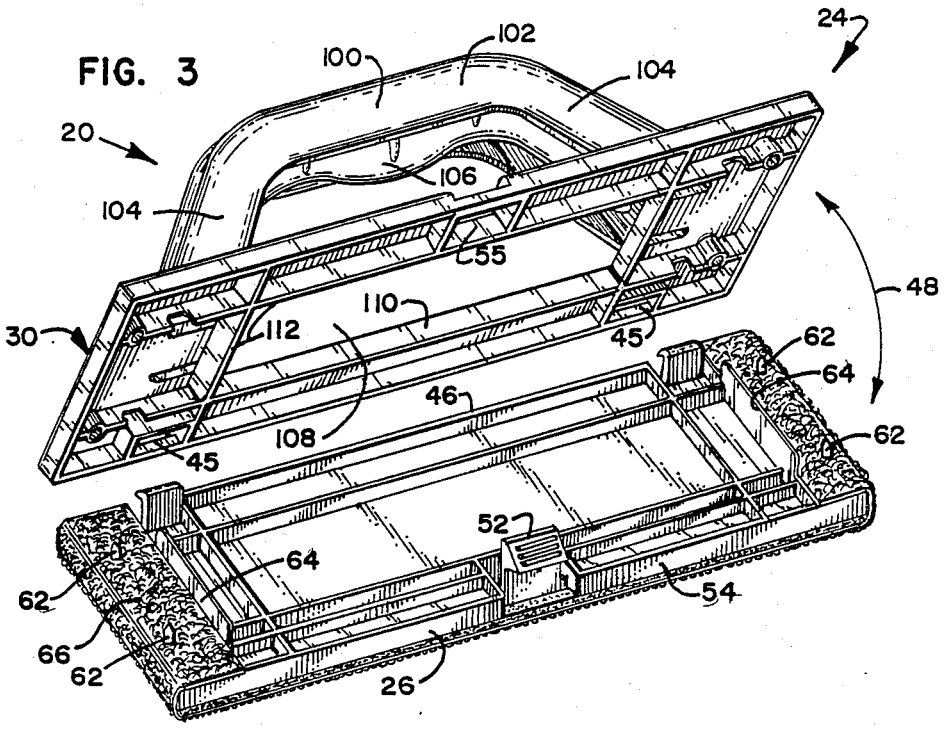
FIG. 3 is a view and perspective of the embodiment shown in FIG. 2 in an opened position.
Figure 4:
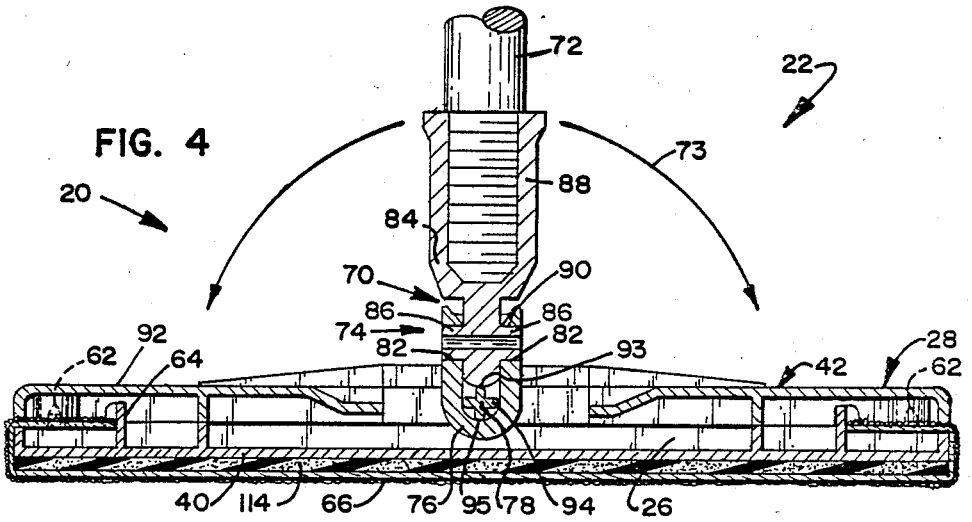
FIG. 4 is an enlarged longitudinal cross-sectional view of the embodiment shown in FIG. 1.
Figure 5:
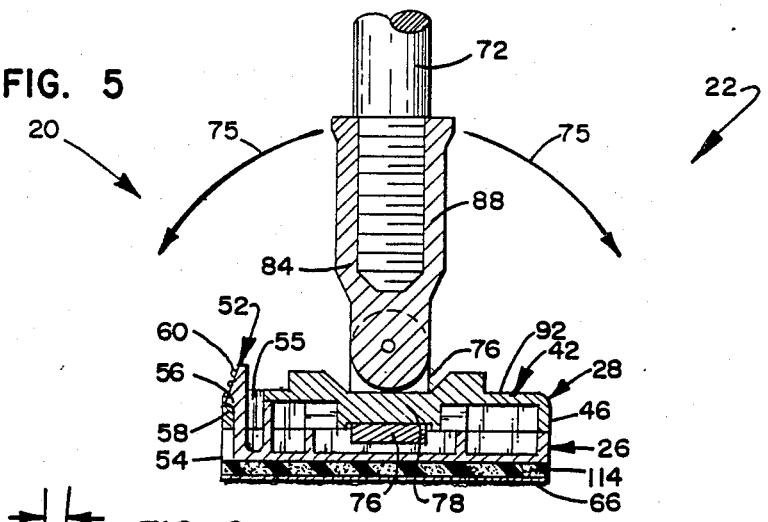
FIG. 5 is a transverse cross-sectional view of the embodiment shown in FIG. 1.

Referring now to the figures, there is illustrated in FIGS. 1 and 2 embodiments of a pole sander 22 and a hand sander 24 generally in accordance with the principles of the present invention. The hand sander 24 and the pole sander 22 include a base structure 26 which is identical for both. The hand sander 24 includes a hand sander top structure 30 and the pole sander 22 includes a pole sander top structure 28. Throughout the specification, wherein the pole sander 22 and the hand sander 24 are commonly referred to, reference will be made to a sander tool 20. The hand sander top structure 30 and the pole sander top structure 28 are interchangeable on the base structure 26. In a preferred embodiment of the present invention, the base structure 26, the hand sander top structure 30, and the pole sander top structure 28 are sold as a kit assembly, thereby effectively providing two sander tools in one kit. The base structure 26 and the top structures 28,30 are preferably molded from a plastic, such as polyethylene. In the preferred embodiment, the base structure 26 and the top structures 28,30 are preferably molded as a one piece integral unit. The base structure 26 includes a substantially planar back surface 40 facing away from the top structures 28,30. The top structures 28,30 in turn, include a handle mounting surface 42 facing away from the base structure 26. Two spaced apart hinge members 44 are integrally molded to the base structure 26 along a first side 46 of the sander tool 20. As illustrated by the arrow 49 in FIG. 3, the hinges 44 cooperate with apertures 45 in the top structures 28,30 to allow for pivotal movement of the top structures 28,30 relative to the base structure 26 such that the base and top structures can be hinged apart into an open position and hinged together in a closed position. In addition, the hinges include a shoulder portion 48 engaging an edge 50 of the top structures 28,30 when the top structures 28,30 are pivoted in the closed position and disengaging from the edge portion 50 when the top structures 28,30 are pivoted into the opened position, thereby enabling removal of the top structures 28,30 from the base structure 26. A latch member 52 is integrally molded to the base structure 26 along a second side 54 and includes a shoulder portion 56 for engaging an edge portion 58 of the top structures 28,30. An aperture 55 is defined in the top structure for enabling passage of the latch member 52 therethrough when the sander tool 20 is pivoted into an opened position. A latch member 52 is preferably resilient and normally being resiliently biased into a rest position wherein it engages the edge portion 58 when the sander tool is in a closed position. To open the sander tool 20, the latch member 52 is forced inward toward the sander tool housing so as to cause the shoulder portion 56 to disengage the edge portion 58, and thereby enabling the top structures 28,30 to be pivoted into the open position. As illustrated, in the preferred embodiment, the latch member includes a knurled surface 60.

As further illustrated, the sander tool 20 preferably includes sandpaper retention members 62 integrally molded to the base structure 26 and a transversely extending barrier 64 providing for alignment of sandpaper 66.

In use, the user selects the top structure 28,30 to be used. Sandpaper 66 is abutted against the sandpaper alignment barriers 64 displaced inwardly from each end of the base structure 26 and pierced onto the sandpaper retention members 62, there being a total of four such retention members. The top structure is then pivoted into the closed position. The user then grasps a handle provided on the handle mounting surface of the top structure selected and begins normal operation.

As illustrated in FIG. 1, the pole sander top structure 28 includes a handle joint assembly 70 for interconnecting a handle member 72 to the top structure 28. The handle joint assembly includes a universal joint 74 mounted on the top structure 28 for allowing the back surface 40 of the base structure 26 to be disposed in a plurality of angular positions with respect to the handle member 72. In a preferred embodiment, the universal joint 74 includes a u-shaped member 76 straddling a pin member 78 integrally molded to the top structure 28 for pivotal motion about a first axis 73. Free ends 80 of the u-shaped member 76 defines spaced, aligned apertures 82. The handle joint assembly 70 further includes a handle attachment arrangement 84 including pin members 86 for pivotal mounting of the handle attachment arrangement 70 in the aligned apertures 82 of the u-shaped member 76 for pivotal movement of the handle attachment assembly about a second axis 75 perpendicular to the first axis whereby substantially universal movement of the handle member 72 is obtained. In the embodiment shown, the handle attachment arrangement includes an internally threaded cylindrical receptacle 88 which threadedly receives the handle member 72.

Figure 6:
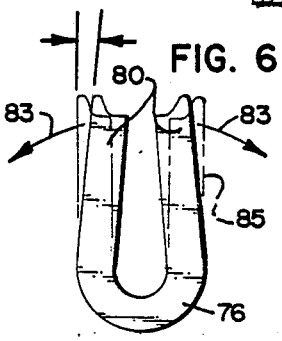
FIG. 6 is a side elevational view of an embodiment of a u-shaped member in accordance with the principles of the present invention illustrating the u-shaped member in its rest position, a displaced position being illustrated in phantom lines.
Figure 7:
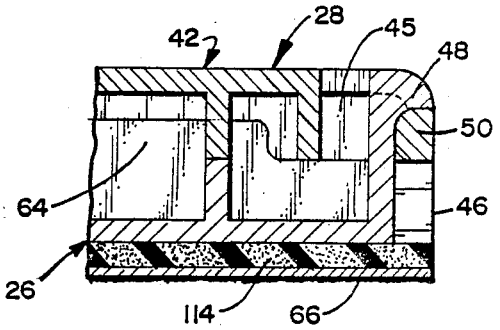
FIG. 7 is a cross-sectional view of an embodiment of a hinge arrangement in accordance with the principles of the present invention.

As illustrated in FIG. 6, the u-shaped member 76 is preferably resiliently biased toward a rest position. The resilient u-shaped member 76 is displaced from the rest position when pivotally mounted onto the pin members 86 of the handle attachment arrangement 84 as generally illustrated by arrows 83 and phantom line 85, thereby providing for a friction engagement between the u-shaped members 76 and the handle attachment arrangement 84. Further, in the preferred embodiment, the pin members 86 frictionally engage an interior surface 90 of the u-shaped member 76 defining the apertures 82. In a preferred embodiment, the pin members are integrally molded along with the receptacle 88, the u-shaped member 76 being separately molded.

In the preferred embodiment, the pin member 78 is preferably molded to the top structure 28 and is recessed within the top structure 28 below a top surface 92 of the handle mounting surface 42. Additionally, the pin member 78 preferably includes four equally spaced apart, radially extending ribs 94, the ribs 94 frictionally engaging the u-shaped member to provide a frictional engagement with the u-shaped member 76 about a selected range of pivotal movement of the u-shaped member 76. Similarly, the ribs 94 frictionally engage a bottom surface 93 of the handle attachment arrangement 70 and a bottom surface 95 of the u-shaped member 76.

The top structure 30 of the hand sander 24 is illustrated as including a handle member 100 integrally molded with the top structure 30. The handle member 100 is illustrated as extending longitudinally of the top surface 30 and including an intermediate portion 102 interconnecting to downwardly extending ends 104 which are connected to the top structure 30. The intermediate portion 102 is spaced apart from the top structure 30 so as to allow for placement of a user's hand between the top structure 30 and the intermediate portion 102 of the handle member 100. In the preferred embodiment shown, the handle member 100 includes a downwardly extending arcuately contoured portion 106 thereby providing for a comfortable grip. Additionally, in the preferred embodiment, the top structure 30 defines a recess 108 beneath the handle member 100 thereby providing additional space for a user's hand. The top structure 30 cooperates with the base structure 26 to provide a barrier 110 around the recess so as to trap any sanding dust.

In a preferred embodiment, as illustrated, the sander tool apparatus has a thin wall construction with integrally molded reinforcement members 112 providing for a sander tool which is strong and rigid. In the preferred embodiment, a soft, pliable backing material 114 is adhesively secured to the back surface 40. The backing material 114 might be composed of rubber or the like.

It is to be understood that even though numerous characteristics and advantages of the present invention have been set forth in the foregoing description, together with details of the structure and function of the invention, the disclosure is illustrative only and changes may be made in detail, especially in matters of shape, size and arrangement of parts within the principles of the invention, to the full extent indicated by the broad general meaning of the terms in which the appended claims are expressed.

What is claimed is:

1. A sander tool apparatus for use with a sheet of sandpaper, the sander tool apparatus comprising:

(a) a two-piece housing structure including a molded base structure, a molded top structure, the base structure including a substantially planar back surface facing away from the top structure, the top structure including a handle mounting surface facing away from the base structure;

(b) hinge means integrally molded with the housing structure for hingedly interconnecting the base and top structures along a first side of the sander tool apparatus, whereby the sander tool apparatus can be placed in an opened position wherein the base and top structures are hinged apart and a closed position wherein the base and top structures are hinged together;

(c) sandpaper retention means for removably retaining the sandpaper from the back surface of the base structure; and (d) latch means integrally molded with the housing structure for releasably latching the base and top structures in the closed position; wherein the top structure includes handle joint assembly means for interconnecting an elongated handle member to the top structure, the handle joint assembly means including universal joint means mounted on the top structure for allowing the back surface of the base structure to be disposed in a plurality of angular positions with respect to the handle member; wherein the universal joint means includes a u-shaped member straddling pin means of the to structure for pivotal movement about a first axis, free ends of the u-shaped member defining spaced apart, aligned apertures, the handled joint assembly means including handle attachment means for attachment to the handle member, the handle attachment means including pin means for pivotal mounting in the aligned apertures of the u-shaped member for pivotal movement of the handle attachment about a second axis perpendicular to the first axis; wherein the top structure pin means includes an elongated pin member having four equally spaced apart, radially extending ribs, the ribs frictionally engaging the u-shaped member to provide a frictional engagement with the u-shaped member about a selected range of pivotal movement of the u-shaped member.

2. A sander tool apparatus for use with a sheet of sandpaper, the sander tool apparatus comprising:

(a) a two piece housing structure having a molded plastic base structure and a molded plastic top structure, the molded top structure being removable from the molded base structure without disassembly of any parts, the base structure including a substantially planar back surface facing away from the top structure, the top structure including a handle mounting surface facing away from the base structure, the base and top structures including their sidewalls perpendicular the back surface and the handle mounting surface, respectively, their sidewalls being thinner than their height, the base and top structures including integrally molded reinforcement members;

(b) hinge means integrally molded with the housing structure and substantially flush with the sides of the housing structure for hingedly and interchangeably interconnecting the base and top structures along a first side of the sander tool apparatus, the sander tool including an open position wherein the base and top structures are hinged apart and a closed position wherein the base and top structures are hinged together, the hinge means enabling the disengagement of the base and top structures when in the open position so that the base and top structures can abe separated from one another, the hinge means including at least one vertically extending member disposed along a first side of the base structure and receivable in at least one aperture disposed along a first side of the top structure when the sander tool is in the open position, the vertical member including a shoulder portion overhanging a surface of the top structure when the sander tool is in the closed position;

(c) sandpaper retention means integrally molded with the housing structure for aligning and removably retaining the sandpaper between the opposing top and base structure so that the sandpaper is retained on the back surface of the base structure, wherein the sandpaper is not necessarily removed and may be retained on the base structure and transferred with the base structure when interconnecting the base structure to other top structures;

(d) resilient latch means disposed along a second side of housing structure opposite the first side and integrally molded with the housing structure for releasably latching the base and top structures in the closed position, the latch means including a resilient latch member integrally molded with the base structure and being movable between a rest position and a displaced position, the latch member being resiliently biased toward the rest position, the latch member being insertable through an opening in the top structure, the latch member including a shoulder portion overhanging a surface of the top structure upon being biased into the rest position after insertion through the opening, the latch means and the hinge means cooperating to prevent separation of the top structure from the bottom structure, when the latch member has been inserted through the opening and is in the rest position, the top structure being separable from the bottom structure only upon movement of the latch member to the displaced position; and (e) handle joint means being mounted on the handle mounting surface of the top structure for interconnection to an elongated handle member, the handle joint means including universal joint means mounted on the top structure for allowing the back surface of the base structure to be disposed in a plurality of angular positions with respect to the handle member, the universal joint means including a one piece resilient U-shaped member pivotally straddling a pin member mounted on the top structure for pivotal movement about a first axis, the pin member extending across an opening in the handle mounting surface the U-shaped member defining spaced apart, aligned apertures in its ends, the handle joint means further including a pole receptor member pivotally mounted between the ends of the U-shaped member in the spaced apart, aligned apertures of the ends of the U-shaped member for pivotal movement about a second axis perpendicular to the first axis, the ends of the U-shaped member being resiliently biased toward a rest position into frictional engagement with the pole receptor member.

3. A sander tool apparatus for use with a sheet of sandpaper, the sander tool apparatus comprising:

(a) a two piece housing structure having a molded plastic base structure and a molded plastic top structure, the molded top structure being removable from the molded base structure without disassembly of any parts, the base structure including a substantially planar back surface facing away from the top structure, the top structure including a handle mounting surface facing away from the base structure, the base and top structures including their sidewalls perpendicular the back surface and the handle mounting surface, respectively, their sidewalls being thinner than their height, the base and top structures including integrally molded reinforcement members;

(b) hinge means integrally molded with the housing structure and substantially flush with the sides of the housing structure for hingedly and interchangeably interconnecting the base and top structures along a first side of the sander tool apparatus, the sander tool including an open position wherein the base and top structures are hinged apart and a closed position wherein the base and top structures are hinged together, the hinge means enabling the disengagement of the base and top structures when in the open position so that the base and top structures can be separated from one another, the hinge means including at least one vertically extending member disposed along a first side of the base structure and receivable in at least one aperture disposed along a first side of the top structure when the sander tool is in the open position, the vertical member including a shoulder portion overhanging a surface of the top structure when the sander tool is in the closed position;

(c) sandpaper retention means integrally molded with the housing structure for aligning and removably retaining the sandpaper between the opposing top and base structure so that the sandpaper is retained on the back surface of the base structure, wherein the sandpaper is not necessarily removed and may be retained on the base structure and transferred with the base structure when interconnecting the base structure to other top structures;

(d) resilient latch means disposed along a second side of housing structure opposite the first side and integrally molded with the housing structure for releasably latching the base and top structures in the closed position, the latch means including a resilient latch member integrally molded with the base structure and being movable between a rest position and a displaced position, the latch member being resiliently biased toward the rest position, the latch member being insertable through an opening in the top structure, the latch member including a shoulder portion overhanging a surface of the top structure upon being biased into the rest position after insertion through the opening, the latch means and the hinge means cooperating to prevent separation of the top structure from the bottom structure, when the latch member has been inserted through the opening and is in the rest position, the top structure being separable from the bottom structure only upon movement of the latch member to the displaced position; and (e) the top structure including a handle member disposed on the handle mounting surface of the top structure, the handle member being integrally molded with the second top structure, the handle member including an intermediate portion extending longitudinally of the top structure and interconnected to the top structure by a downwardly extending portion, the intermediate portion being spaced apart from the top structure and disposed over an opening in the top structure to allow for placement of the user's hand between the top structure and the intermediate portion of the handle member, the intermediate portion further including a downwardly extending curvilinear portion.

* * * * *